US010487582B2

(12) United States Patent
Wright et al.

(10) Patent No.: US 10,487,582 B2
(45) Date of Patent: Nov. 26, 2019

(54) TOOL CARRIER FOR A WELL RIG

(71) Applicant: Prostar Energy Technologies (USA) LLC, Leduc (CA)

(72) Inventors: Adam Wright, Calgary (CA); Jason Peter Clarke, Calgary (CA)

(73) Assignee: Prostar Energy Technologies (USA) LLC, Leduc (CA)

( * ) Notice: Subject to any disclaimer, the term of this patent is extended or adjusted under 35 U.S.C. 154(b) by 0 days.

(21) Appl. No.: 16/438,129

(22) Filed: Jun. 11, 2019

(65) Prior Publication Data

US 2019/0292851 A1 Sep. 26, 2019

Related U.S. Application Data

(62) Division of application No. 16/283,252, filed on Feb. 22, 2019, which is a division of application No. 15/374,067, filed on Dec. 9, 2016, now abandoned.

(60) Provisional application No. 62/266,382, filed on Dec. 11, 2015.

(51) Int. Cl.

| | |
|---|---|
| ***E21B 7/02*** | (2006.01) |
| ***E21B 15/00*** | (2006.01) |
| ***E21B 19/07*** | (2006.01) |

(52) U.S. Cl.

CPC ..... *E21B 7/023* (2013.01); *E21B 7/02* (2013.01); *E21B 15/00* (2013.01); *E21B 19/07* (2013.01)

(58) Field of Classification Search

CPC ... E21B 3/02; E21B 7/02; E21B 7/023; E21B 7/022

See application file for complete search history.

(56) References Cited

U.S. PATENT DOCUMENTS

| | | | | |
|---|---|---|---|---|
| 2,792,198 | A | 5/1957 | Braun | |
| 3,278,163 | A | 10/1966 | Marks et al. | |
| 3,438,450 | A | 4/1969 | Failing | |
| 4,843,945 | A | 7/1989 | Dinsdale | |
| 2005/0274508 | A1* | 12/2005 | Folk | E21B 19/02 166/77.52 |
| 2009/0151934 | A1* | 6/2009 | Heidecke | E21B 3/02 166/250.01 |
| 2015/0259984 | A1 | 9/2015 | Taggart et al. | |

* cited by examiner

*Primary Examiner* — D. Andrews

(74) *Attorney, Agent, or Firm* — Christensen O'Connor Johnson Kindness PLLC

(57) ABSTRACT

A tool carrier, which is also known as a top drive or a power swivel, for a well operation rig includes link arms coupled between the rotating hook assembly and the lower pipe gripping structure, the link arms each secured to the rotating hook assembly by a first rigid connection and secured to the lower pipe gripping structure by a second rigid connection such that the link arms can extend along well center even when operating in slant. Another tool carrier includes a hinge between the mast and the main housing. The hinge permits the tool carrier to be moved into a more central position when folded onto the rig chassis for transport.

7 Claims, 5 Drawing Sheets

TOOL CARRIER FOR A WELL RIG

CROSS-REFERENCE TO RELATED APPLICATION

This application is a divisional of U.S. patent application Ser. No. 16/283,252 (pending), filed Feb. 22, 2019, which is a divisional of U.S. patent application Ser. No. 15/374,067 (abandoned), filed Dec. 9, 2016, which claims the benefit under 35 U.S.C. § 119(e) of U.S. Provisional Patent Application No. 62/266,382, filed Dec. 11, 2015. All applications are incorporated by reference herein in their entirety.

BACKGROUND

Rigs are used in wellbore operations such as drilling and servicing.

Tool carriers are employed in a rig to move one or more tools, and structures such as pipes and hoses, vertically relative to the mast. Tool carriers also pick up and manipulate the pipes and tools that are connected to form the wellbore string, such as a drill string, work string, liner, casing, etc.

In some embodiments, the tool carrier can be configured to hold any tool used in the drilling or servicing of wells, as is well known to those skilled in the art. A tool carrier can comprise a top drive or a power swivel. In the drilling of wells, a top drive unit can be used. In the servicing of wells, a power swivel or a top drive can be used. Top drives and power swivels can be similar in function and operation, the difference being that top drives can be larger in size and power, as may be required for the drilling of wells.

The tool carrier is installed in the mast on a drive assembly, which moves the tool carrier along the mast.

A tool carrier may be quite large and heavy. Generally, a tool carrier includes tool support structures for holding tools over well center and a back frame supporting the tool support structures and through which the tool carrier is connected to the drive assembly.

Slant rigs, which is a rig where the mast is oriented at an angle off vertical, present challenges to the operation of a tool carrier, as gravity cannot be employed to hold and center the tool support structures over well center.

SUMMARY

In accordance with a broad aspect of the present invention, there is provided a tool carrier for a well operation rig, comprising: tool support structures; and a bracket to connect the tool support structures into a mast of the well operation rig, the bracket including: a first portion mountable onto the mast; a second portion connected to the tool support structures; and a hinge configured to permit the second portion to pivot away from the first portion, while the first portion remains connected to the second portion.

In accordance with another broad aspect of the present invention, there is provided a tool carrier for a well operation rig, comprising: one or more tool support structures configured to remain centralized along a center line against the force of gravity in a slant rig.

In accordance with another broad aspect of the present invention, there is provided a truck-conveyed well operation rig comprising: a truck with a chassis, the chassis having a front, a back, a left side and a right side; a rig mast folded in a transport position on the chassis, the rig mast including an upper mast section supported on and extending along a length of the chassis and a lower mast section extending alongside the upper mast section; and a tool carrier connected to the rig mast and carried in a substantially central position between the left side and the right side.

In accordance with another broad aspect of the present invention, there is provided a method for storing a well operation rig for transport, the method comprising: folding an upper mast section about a pivotal connection down against a lower mast section; pivoting a tool carrier on a hinge connected between the tool carrier and the lower mast section to move the tool carrier away from the lower mast section toward the upper mast section; and lowering the lower mast section and the upper mast section onto a chassis of the well operation rig, wherein the tool carrier is positioned above the lower mast section and the upper mast in a substantially central position between a left side and a right side of the chassis.

In accordance with another broad aspect of the present invention, there is provided a tool carrier for a well operation rig, comprising: a main housing; a mounting bracket configured to mount the main housing to a rig mast; a drive system for imparting rotational drive through a quill; a rotating hook assembly; a lower pipe gripping structure; and link arms coupled between the rotating hook assembly and the lower pipe gripping structure, the link arms each secured to the rotating hook assembly by a first rigid connection and secured to the lower pipe gripping structure by a second rigid connection. It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly, the drawings and detailed description are to be regarded as illustrative in nature and not as restrictive.

DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope.

In the drawings:

FIGS. 3*a* to 3*d* show a tool carrier for slant or vertical operations, wherein FIG. 3*a* is an upper, rear perspective view of the tool carrier with the hinge open;

FIG. 3*b* is an upper, front perspective view of the tool carrier of FIG. 3*a* with the hinge closed;

FIG. 3*c* is a front view of the tool carrier of FIG. 3*b*; and

FIG. 3*d* is a sectional view along line A-A of the tool carrier of FIG. 3*c*.

DETAILED DESCRIPTION

Figure 1A:
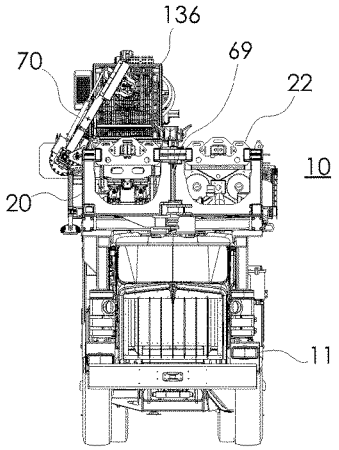
FIGS. 1*a* and 1*b* are end and top, rear perspective views, respectively of a rig apparatus with the mast folded for transport and a tool carrier supported in its mast.

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

This invention relates to a tool carrier for a well operation rig.

Some well operation rigs, such as drilling or service rigs, are truck conveyed. One such rig apparatus 10 is illustrated in FIGS. 1*a* to 1*d*. In some embodiments, rig apparatus 10 can comprise a substructure comprising a vehicle and a support frame, as represented by truck 11 with a cab and a chassis. Truck 11 can comprise a heavy-duty tractor such as those used in a tractor-trailer unit, as well known to those skilled in the art. In some embodiments, rig apparatus 10 can be driven to a well location, either to drill a well or to service an existing well, shown as blow-out preventer ("BOP") which will define well centre ("WC"). Rig apparatus 10 can comprise many components such as hydraulic drive assembly, platform and mast 25.

In some embodiments, mast 25 can comprise upper mast section 22 hinged to lower mast section 20 about hinge joint 24. Lower mast section 20 can further be pivotally attached to rig apparatus 10. Jack knife hydraulic cylinders can provide the means for rotating upper mast section 22 relative to lower mast section 20. When the cylinders are retracted, upper mast section 22 can rotate about hinge 24 to fold upper mast section 22 to lower mast section 20, similar to closing a jack knife. When the cylinders are extended, upper mast section 22 can rotate about hinge 24 away from lower mast section 20, and erect mast 25. In some embodiments, lower mast section 20 (with upper mast section 22 folded against lower mast section 20) can be raised to a vertical position first, and then upper mast section 22 can then be raised to form mast 25.

In any event, mast 25 is folded for transport (as shown) and it is moved to an erected position for use. In some rigs, the mast is folded with upper mast 22 alongside lower mast 20 for transport.

If a tool carrier is employed in the rig, it is installed in the mast for use. For example, tool carrier 36, 136 is installed in the mast on a drive assembly 30, which moves the tool carrier along the mast. A tool carrier may be quite large and heavy. Generally, a tool carrier includes tool support structures for holding tools over well center and a mounting bracket 21 supporting the tool support structures and through which the tool carrier is connected to the drive assembly.

Two different types of tool carriers 36, 136 are shown in FIG. 2 and FIGS. 3*a*-3*d*, respectively. However, functionally equivalent parts are shown with similar numbering wherein a two digit numbering is used for FIG. 2 and a similar part in FIG. 3 uses 100 series numbering but with the 2 digit base number from FIG. 2.

Figure 2:
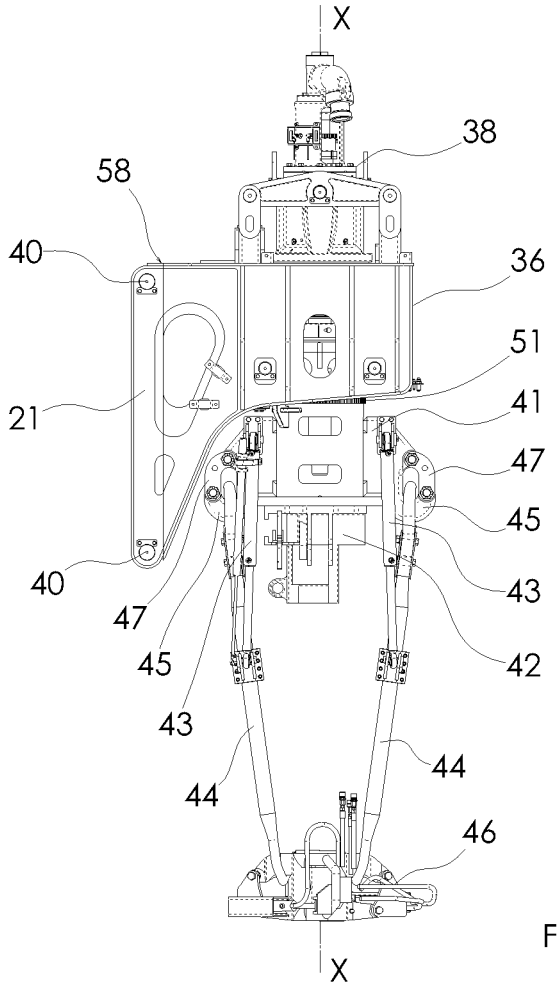
FIG. 2 is a side elevation of a tool carrier for vertical operations.
Figure 3A:
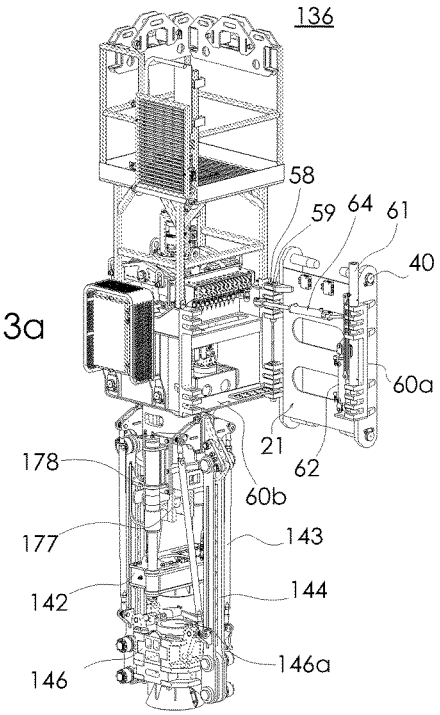
Figure 3B:
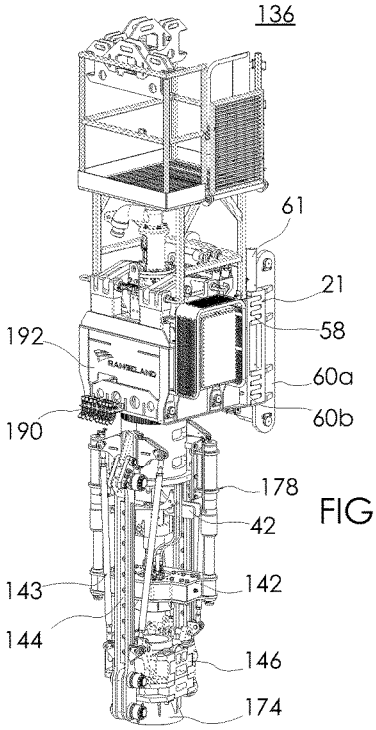
Figure 3C:
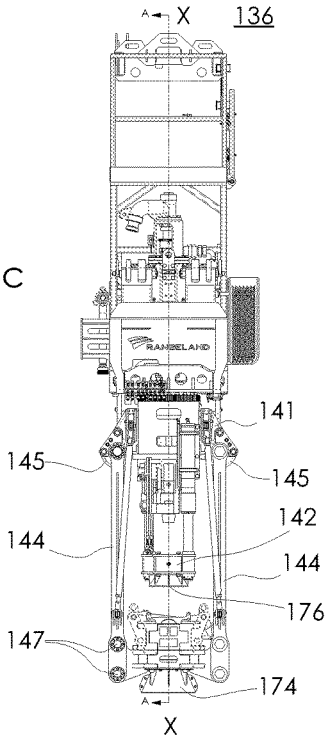
Figure 3D:
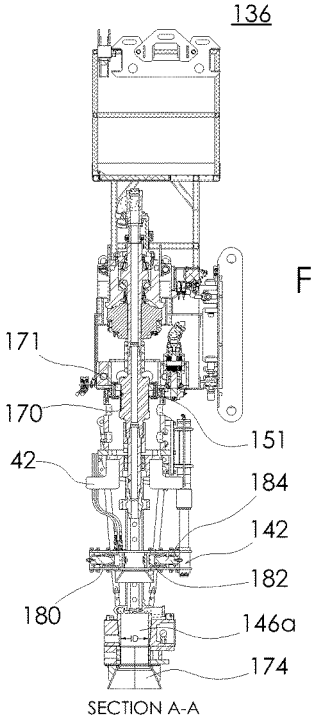

In some embodiments, for example FIG. 2, tool carrier 36 can comprise one or more tool support structures such as upper pipe gripping members 42, wobble drive motor that can rotate slew bearing gear set 51 about the longitudinal axis of the pipe so as to enable a pivot box assembly to wobble pipe, which rotates the string clockwise and counter clockwise about the longitudinal axis of the pipe to reduce friction as the string is pushed into a wellbore. Tool carrier 36 also includes lower tool support structures extending below the main body relating to pipe handling such as rotating hook assembly 41, lower pipe gripping members, link arms 44, arms, etc. For example, tool carrier 36 can comprise link arms 44 connected to lower pipe gripping members, which are hydraulic elevators 46 in FIG. 2, that can be used to grab and lift pipe as it is being tripped into or out of a well bore. In some embodiments such as FIG. 2, links 44 can be supported by hooks 45 on rotating hook assembly 41 and can be kept in place on the hooks by retainers 47. Retainers 47 are secured across the open side of the hooks 45, such as with nuts and bolts as one example. In such an embodiment, tool carrier 36 can comprise hydraulic cylinders 43 operatively disposed between links 44 and assembly 41. Cylinders 43 can enable the lifting and pivoting of elevators 46 with respect to assembly 41. When cylinders 43 are retracted, the links are pivoted up about the hooks and, therefore, elevators 46 carried on links 44 are also moved upwards. This positions the elevators 46 to receive a section of pipe when tripping the string into a well, or to present a section of pipe to a pipe handling apparatus when tripping the string out of the well. When cylinders 43 are extended, the links, and elevators 46 thereon, are pivoted down about the hooks until links 44 are substantially aligned with the long axis x of the tool carrier, which in a vertical rig is a substantially vertical position.

While the tool carrier 136 of FIGS. 3*a*-3*d* is different in some respects from that of FIG. 2, it does include one or more tool support structures such as upper pipe gripping members 142, wobble drive motor that can rotate slew bearing gear set 151 about the longitudinal axis of the pipe so as to enable a pivot box assembly to wobble pipe, which rotates the string clockwise and counter clockwise about the longitudinal axis of the pipe to reduce friction as the string is pushed into a wellbore. Tool carrier 136 also includes lower tool support structures extending below the main body relating to pipe handling such as rotating hook assembly 141, lower pipe gripping members 146, link arms 144, arms, etc.

The significant weight of a tool carrier can present difficulties during transport, since if it remains connected to the mast, the tool carrier may cause the rig to be unbalanced from side to side, in other words having an unequal weight distribution from side to side across its chassis. Sometimes this unequal weight distribution presents a risk of the rig apparatus tipping, for example, when cornering away from the heavy side.

In one aspect of the invention, the mounting bracket 21 includes a hinge 58 through which the tool support structures, including for example the upper pipe gripping members 42, the wobble drive motor, the slew bearing gear set, rotating hook assembly 41, the lower pipe gripping structures such as elevators 46, link arms 44, etc., which is the major portion and the heaviest portion of the tool carrier, can be pivoted away from drive assembly 30, while the tool carrier and the drive assembly remain connected together. Hinge 58 is configured to allow the tool support structures to be pivoted away from drive assembly 30 for example, when the mast is folded to thereby permit the weight of the tool carrier to be moved into a more central location from side to side on the rig. Hinge 58 is normally closed during use of the rig, but permits the tool support structures to be pivoted into a more central position on the rig when the mast is folded for transport.

Hinge 58 can include a hinge pin 59 between a mounted leaf 60*a* which connects to drive assembly 30 for example through drive assembly connectors such as pins 40, and a swing leaf 60*b*. Hinge pin 59 is oriented along a height of mounting bracket 21, which is substantially parallel to a long axis x through tool carrier. Hinge 58 also includes a releasable lock 61, which is lockable to prevent the hinge from swinging open during operation of the tool carrier. Hinge 58 is lockable to hold the hinge against pivoting around hinge pin 59 and releasable to permit swing leaf 60*b* to pivot relative to mounted leaf 60*a*. Releasable lock 61 may include a manual or automated pin, latch, etc. In the illustrated embodiment, lock 61 is driven by cylinder 62.

The hinge mechanism is locked by lock 61, which includes hydraulically actuated locking pins which are positionable between alignable apertures on the swing leaves for example opposite hinge pin 59. There may also be a manually removable safety pin that prevents the lock from disengaging. As well, there may be an electrical limit switch sensor, which signals that the locking pins are fully engaged. A controller such as a programmable logic controller may receive the signal.

Hinge 58 can further include a driver, such as a linear actuator for example a cylinder 64, which drives swing leaf 60*b* about hinge pin 59.

The hinge can be used on many types of tool carriers.

In use, to equalize weight distribution from side-to-side on a rig, the tool support structures of a tool carrier are hinged on hinge 58 from the mast portion and drive assembly 30 to which they are connected into a more central location between the sides of a rig.

Generally, the hinge is opened while the mast is still at least partially erect as the weight of the tool carrier would be very difficult to lift over after the mast is entirely folded down for transport. In one embodiment, the mast is first jack knifed, by rotating the upper mast down adjacent the lower mast while the lower mast is still upright and then the hinge is opened to pivot the tool carrier tool support structures away from the portion of the bracket, mounted leaf 60*a*, that is connected into the mast. Hinge opening (i.e. the pivot of swing leaf 60*b* out away from mounted leaf 60*a*) can be carried out first by releasing the lock and then using the driver, such as by extension of cylinder 64, to open the hinge. After the hinge is opened, then the mast, including both the upper mast and the lower mast, is folded down into a horizontal position on the truck 11, as shown in FIGS. 1*c* and 1*d*. The upper mast lies alongside the lower mast, each supported on the chassis in a side-by-side configuration in a single layer as opposed to one on top of the other.

When the mast is folded, the tool carrier remains connected through drive assembly 30 to the drive assembly in the mast, generally in the lower mast section 20. However, the tool support structures are in a more central side to side position on the overall rig, such as over the gap 69 between upper mast 22 and lower mast 20 (FIGS. 1*c* and 1*d*). In one embodiment, the hinge swing is selected to move the tool carrier into a position that balances the weight between the two sides of the rig. Therefore, if the mast has a number of heavy tools such as a pipe loader 70 attached to it, the hinge may be selected to position the tool carrier over the gap 69, but more on one side of the gap than the other as shown.

Figure 1B:
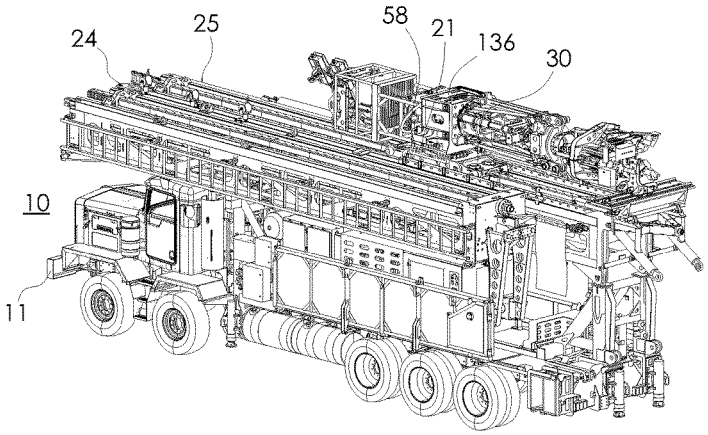
Figure 1C:
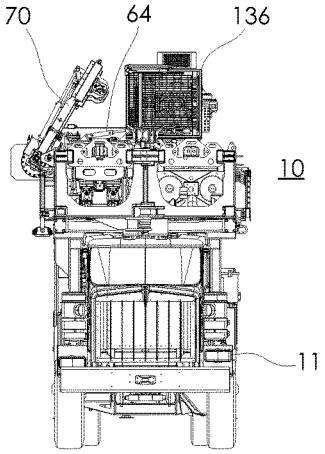
FIGS. 1*c* and 1*d* are end and top, rear perspective views, respectively, of the rig apparatus of FIGS. 1*a* and 1*b* with the tool carrier pivoted for transport.
Figure 1D:
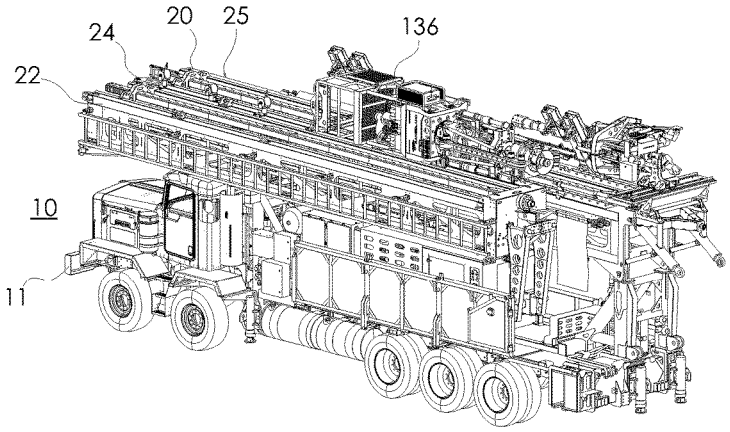

Compare this weight balanced configuration of FIGS. 1*c* and 1*d* to a situation where the tool carrier is not pivoted over into a more central position, such as shown in FIGS. 1*a* and 1*b*. Without pivoting the hinge, tool carrier 36 is directly above one mast section, such as the lower mast section, and therefore would not be centralized: thereby making the rig more unstable.

When erecting a mast, it can be lifted to a partially erect position, for example with lower mast erect, but upper mast section still folded against the lower mast section. Then the hinge can be closed (i.e. swing leaf 60*b* is pivoted to fold over against mounted leaf 60*a*). The hinge is then locked into the closed position. Closing can be carried out using the driver, such as by retraction of cylinder 64, to pivot the swing leaf to overlie the mounted leaf and then lock 61 can be locked. Then, the mast can be fully erected, as by rotating the upper mast section into its erected position above the lower mast section. When hinge 58 is closed, the tool support structures are secured against drive assembly 30 and the tool carrier can be powered up for use.

Tool carrier 36 with hinge 58 can be used on various types of rigs including vertical rigs and slant rigs.

In another aspect, with or without the hinge, a tool carrier 136 has been invented that is particularly suited for use on a slant rig.

Tool carrier operations often rely on components remaining centered over well center. In slant configuration, gravity can pull some prior art tool carrier components off center. While FIG. 2 shows an embodiment of the invention in respect of the hinge, it also illustrates some prior art components which can be referenced against new components in the tool carrier of FIGS. 3*a*-3*d*.

One such component that is impacted by gravity is a cushion sub. The cushion sub cannot be seen in FIG. 2, but it is positioned within the upper tool support structures above or within the rotating hook assembly 41. The cushion sub is utilized to reduce vibration and wear of the string and rig components. The sliding spindle of the cushion sub permits the threads of the mating string components to float together or apart during rotation without any axial movement of the rotary drive. This decreases the impact on the rotary drive when the two mating threads are joined and decreases the load on the threads of the mating components. The cushion sub provides a means of making up and breaking out threaded connections without damaging their threads and it prolongs bearing and gear life of the rotary driver of the tool carrier. Cushion sub 170 is normally intended to rotate within an annular body such as the slew bearing 151 and to be centered within and aligned along the central axis of the annular body. The cushion sub is not coupled to the slew bearing, but rotates within the slew bearing. When the cushion sub and the slew bearing are held with the central axis vertical, the cushion sub hangs in this centered orientation and can rotate readily within the inner bore of the slew bearing. However, when the cushion sub and the slew bearing are in a tool carrier on a slant rig, gravity can move the cushion sub off center. New tool carrier 136 includes a centralizer ring 171 between cushion sub 170 and slew bearing 151.

Centralizer ring 171 encircles the cushion sub and is positioned in the space between ring 171 and slew bearing 151 to maintain the cushion sub in a centralized position within the inner bore of the slew bearing. The circumference of centralizer ring 171 extends orthogonally relative to a long axis of the cushion sub. Centralizer ring 171 may be coupled to the outer diameter of the cushion sub and may rotate therewith. The centralizer ring may have a thickness to substantially span the gap between the cushion sub and the inner diameter of the slew bearing to thereby hold the cushion sub concentrically within the slew bearing inner diameter.

Centralizer ring 171 may be formed of a friction reducing material to facilitate rotation of the cushion sub within the slew bearing. As such, centralizer ring 171 may have plane bearing properties. In one embodiment, centralizer ring 171 is formed of a dense polymer.

Another tool carrier component that may be impacted by an off vertical orientation are the pipe handling apparatus such as the link arms. Prior art pipe handling apparatus such as link arms (item 44 in FIG. 2) are pivotally connected between eyes on the link arm and hooks (item 45 in FIG. 2) of the rotating hook assembly. If used on a slant rig, the link arms of FIG. 2 may pivot away from well center. New tool carrier 136 has a rotating hook assembly 141 similar to prior art assemblies and link arms that are each rigid, non-flexible and non-extensible. New tool carrier 136 includes a pipe handling apparatus with a rigid connection 145 between link arms 144 and rotating hook assembly 141. Each rigid connection 145 includes a non-pivoting, substantially rigid connection between the upper end of each link arm and the rotating hook assembly. For example rigid connection 145 may include a bolt and a plate clamp assembly, which may be secured through the upper eye on each link arm and the hook 45 on the rotating hook assembly to which the link arm is connected. The bolt and clamp creates a rigid connection such that link arm 144 is held from pivoting relative to the hook onto which it is connected. Struts 143 also may be rigidly connected between link arms 144 and assembly 141. There may be front struts and back struts holding arms 144 rigid at connection 145 to assembly 141. The overall non-pivoting, substantially rigid construction ensures that arms 144 and the pipe gripping structure, herein travelling slips 146, held at the lower end of arms 144 are maintained along long axis x of the tool carrier and along well center, even against gravity when long axis x is on a slant (off vertical).

Tool carriers often include upper pipe gripping structures and lower pipe gripping structures.

While the lower pipe gripping structure of prior art pipe handlers are often elevators (item 46 in FIG. 2), an elevator, which includes two pivotally connected clamp sections, may fall open when held at a slant and may thereby lack control against gravity. Thus, the tool carrier includes a pipe handling apparatus with travelling slips 146 on the lower ends of arms 144. Travelling slips 146 include a cylindrical holder 146*a* with an inwardly facing inner diameter ID formed as a frustoconical surface that tapers from its upper end to its lower end and slips that ride up and down along the inwardly facing surface. While the slips may move axially in their holders, they are held and remain concentric about the center axis of inner diameter ID. In addition, the cylindrical holder being non-openable, with a continuous cylindrical wall, it is not impacted by gravity with the tool carrier is on a slant. Travelling slips 146 are electrically or hydraulically powered. Hydraulic powering facilitates cooperation with the hydraulic power system of the tool carrier.

There is also a rigid (i.e. non-pivotally moveable) connection 147 between the lower pipe gripping structure, herein travelling slips 146, and arms 144 to thereby hold the travelling slips with ID centered along a center axis x of the tool carrier, which is aligned along well center during use. Each rigid connection 147 may include, for example, a high compression bolt. In one embodiment, each arm is connected to the travelling slips via more than one connection 147. Such a multipoint connection, for example two spaced apart bolts connecting each arm to the travelling slips, avoids the risk of the arms folding though connections 145 and connections 147.

When handling pipe, tool carrier 136 is moved up until slips 146 are clear of the upper end of the pipe being presented is centered along well center, then slips 146 are moved down over the upper end of the pipe and the slips in inner diameter ID can be actuated to grip the pipe.

The travelling slips 146 may include a conical centralizer guide 174 on the lower end of the cylindrical body 146*a*. The conical centralizer is positioned with its inner bore aligned with the inner diameter of the travelling slips. The inner bore tapers towards the inner diameter and urges a pipe being approached by the travelling slips into a centralized position relative to the inner diameter ID and thereby the slips of the travelling slips.

The upper pipe gripping structures are used to grip an upper end of the pipe, either the pipe sections being handled or the string as a whole. For example, upper gripping structures such as push slips 42 or inverted slips have been used to grip onto the uppermost pipe in a wellbore string so that it can be pushed into the wellbore by the drive assembly. Another type of upper gripping structure is a back-up wrench. While back-up wrenches may have been employed in drilling rigs, this new tool carrier, which is also useful on a service rig, includes a back-up-type wrench as a pipe gripping wrench 142. The pipe gripping wrench is connected to rotating hook assembly 141 and is positioned between travelling slips 146 and quill 177. Wrench 142 grips a pipe that extends up through slips 146 and ensures positioning so that the quill 177 can be threaded into the upper end of the pipe.

Pipe gripping wrench 142 includes a frame 180 defining a jaw opening and clamp jaws 182 supported within the jaw opening. Clamp jaws 182 are driven radially inwardly and outwardly by clamp cylinders 184. The lower end of wrench 142 may also have secured thereto a conical centralizer guide 176 surrounding the lower end of the jaw opening. Guide 176 works in the same manner as noted above in respect of guide 174, to accommodate any sag of the pipe being handled and to ensure the pipe is urged into a centralized position relative to the inner diameter of jaw opening of the wrench.

Adjustable back-up arms 178 connect the frame of the wrench to the rotating hook assembly of the tool carrier. Arms 178 have an adjustable length and are synchronized. The arms may be formed of linear actuators such as cylinders (as shown). Arms 178 are retractable and extendable, to move frame 180 towards and away from quill 177. Arm length adjustability allows the clamping jaws 182 of the pipe gripping wrench to be moved to a position suitable to grip a pipe joint aligned along well center. Thereafter, arms 178 can be retracted to guide the quill toward the pipe being gripped. The cylinders of arms 178 are shown extended down in FIG. 3*a* and retracted up in FIGS. 3*b*-3*d*.

Wrench 142 may also be powered by hydraulics.

Hydraulic lines may extend down from source hydraulics 190 on the main housing 192 of the tool carrier toward pipe gripping wrench 142 and travelling slips 146. In one embodiment, a hydraulic rotary union may be provided to facilitate connection between the fixed source hydraulics and the lines running to rotating parts at and below the rotating hook assembly.

In operation, the lower pipe gripping structures, for example travelling slips 146 which are mounted in the slip hanger and positioned by rigid link arms, are used to grip and hold the string to allow it to be lowered (tripped) into the wellbore or pulled up (tripped) out of the wellbore. When the swivel component of the tool carrier is to be used, such as for drilling operations, to rotate the pipe string, the back-up wrench is used to grip the pipe and allow the swivel to thread into the pipe. The back-up wrench is then released and the swivel can then support the pipe string and rotate it to achieve drilling and milling operations. In another embodiment, pipe gripping wrench 142 can be operated to grip, rotate and push the pipe string with or without connection to quill 177. In such an embodiment, the tool carrier can be operated without inverted slips.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or "step for."

The embodiments of the invention in which an exclusive property or privilege is claimed are defined as follows:

1. A tool carrier for a well operation rig, comprising:

a main housing;

a mounting bracket configured to mount the main housing to a rig mast;

a drive system for imparting rotational drive through a quill;

a rotating hook assembly;

a lower pipe gripping structure; and link arms coupled between the rotating hook assembly and the lower pipe gripping structure, the link arms each secured to the rotating hook assembly by a first rigid connection and secured to the lower pipe gripping structure by a second rigid connection.

2. The tool carrier of claim 1 wherein the first rigid connection includes a bolt and plate clamp assembly securing an upper end of the link arm to a hook on the rotating hook assembly.

3. The tool carrier of claim 1, further comprising a rigid strut connected between each link arm and the rotating hook assembly.

4. The tool carrier of claim 1 wherein the second rigid connection is a multipoint connection.

5. The tool carrier of claim 1 wherein the lower pipe gripping structure is travelling slips.

6. The tool carrier of claim 1 wherein the drive system includes a cushion sub within a slew bearing and a centralizer ring encircling the cushion sub and positioned in a space between the cushion sub and the slew bearing.

7. The tool carrier of claim 1, further comprising a pipe gripping wrench coupled to the rotating hook assembly and positioned between the lower pipe gripping structure and the quill.

* * * * *